United States Patent [19]

Olsen et al.

[11] 4,019,082

[45] Apr. 19, 1977

[54] ELECTRON EMITTING DEVICE AND METHOD OF MAKING THE SAME

[75] Inventors: Gregory Hammond Olsen, Cranbury; Ramon Ubaldo Martinelli, Hightstown; Michael Ettenberg, Freehold, all of N.J.

[73] Assignee: RCA Corporation, New York, N.Y.

[22] Filed: Mar. 24, 1975

[21] Appl. No.: 561,353

[52] U.S. Cl. ..... 313/346 R; 29/572; 313/94; 313/103 R; 357/30; 427/77

[51] Int. Cl.[2] ..... H01J 1/14; H01J 19/06

[58] Field of Search ..... 313/94, 95, 103, 346, 313/373; 357/30; 427/74, 77, 160; 29/572

[56] References Cited

UNITED STATES PATENTS

| | | | |
|---|---|---|---|
| 3,478,213 | 11/1969 | Simon et al. | 313/103 |
| 3,669,735 | 6/1972 | Fisher | 313/94 |
| 3,696,262 | 10/1972 | Antypas | 313/94 |
| 3,868,523 | 2/1975 | Klopfer et al. | 313/94 |
| 3,889,143 | 6/1975 | Gowers | 313/94 |
| 3,901,745 | 8/1975 | Pion | 313/95 |

FOREIGN PATENTS OR APPLICATIONS

| | | | |
|---|---|---|---|
| 1,342,005 | 12/1973 | United Kingdom | 313/94 |

*Primary Examiner*—Saxfield Chatmon, Jr.
*Attorney, Agent, or Firm*—G. H. Bruestle; D. S. Cohen

[57] ABSTRACT

A substrate of single crystalline gallium arsenide has on a surface thereof a layer of single crystalline indium gallium phosphide. A layer of single crystalline gallium arsenide is on the indium gallium phosphide layer and a work function reducing material is on the gallium arsenide layer. The substrate has an opening therethrough exposing a portion of the indium gallium phosphide layer.

11 Claims, 4 Drawing Figures

ELECTRON EMITTING DEVICE AND METHOD OF MAKING THE SAME

BACKGROUND OF THE INVENTION

The invention described herein was made in the course of, or under, subcontract 11-6604 with the U.S. Atomic Energy Commission.

The present invention relates to an electron emitting device and particularly to such a device which can be used as a transmission secondary emission dynode.

Transmission secondary emission dynodes have heretofore been fabricated from single crystalline gallium arsenide. For example, such a dynode is shown and described in U.S. Pat. No. 3,478,213 issued to R. F. Simon et al., Nov. 11, 1963, entitled "Photomultiplier Or Image Amplifier With Secondary Emission Transmission Type Dynodes Made of Semiconductive Material With Low Work Function Material". As described in this patent, the dynodes are thin layers of single crystalline gallium arsenide having on one side a layer of a work function reducing material to achieve negative electron affinity.

In the use of such dynodes primary electrons are directed into the gallium arsenide layer through its back surface, i.e., the surface opposite that having the work function reducing material. The primary electrons entering the gallium arsenide layer create numerous secondary electrons which diffuse to the front surface, i.e., the surface having the work function reducing material. The secondary electrons are emitted into a vacuum as a result of the negative electron affinity. In this manner the dynode achieves electron multiplication. The dynode has direct application in image intensifier tubes and photomultiplier tubes.

A problem arises with this type of dynode as a result of the fact that the back surface of the gallium arsenide layer is a free, exposed surface. Such a free surface contains surface energy states which trap electrons which reach the vicinity of the surface. Thus, the normalized surface recombination velocity ($S_b$) of electrons is increased by the presence of this free surface so that the number of electrons which escape from the dynode into the vacuum is greatly reduced. In fact, the transmission mode gain in such a dynode is less than the reflection mode gain.

One technique which has been considered to overcome this problem is to cover the back surface of the gallium arsenide layer so that it is no longer a free surface. However, the material used to cover the back surface of the gallium arsenide layer must be transparent to electrons to permit the electrons to pass through the material into the gallium arsenide layer. Also, it is desirable that the cover material have a bandgap energy higher than that of the gallium arsenide so as to provide an interface with the gallium arsenide layer which will reflect electrons which reach the interface back into the gallium arsenide layer. In addition, the cover material must be of a nature that in making the dynode the cover material will not adversely effect the crystalline quality of the gallium arsenide layer.

SUMMARY OF THE INVENTION

An electron emitting device includes a first body of single crystalline gallium arsenide having opposed, substantially flat surfaces. A second body of single crystalline indium gallium phosphide is on one of the surfaces of the first body, and a layer of a work function reducing material is on the other surface of the first body.

DETAILED DESCRIPTION

Figure 1:
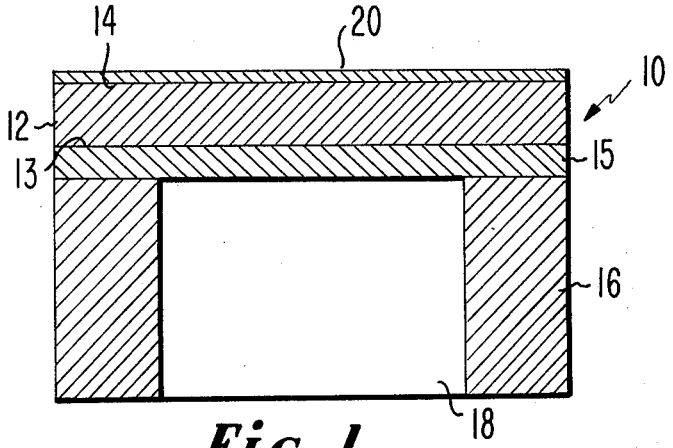
FIG. 1 is a sectional view of the electron emitting device of the present invention.

Referring initially to FIG. 1, a form of the electron emitting device of the present invention is generally designated as 10. The electron emitting device 10 comprises a first body 12 of single crystalline gallium arsenide having a pair of opposed, substantially flat surfaces 13 and 14. The first body 12 is of *p* type conductivity, preferably having a carrier concentration of between approximately $3 \times 10^{18}$ cm$^{-3}$ and $1 \times 10^{19}$ cm$^{-3}$, and is preferably of a thickness of between 1 and 4 microns. On the surface 13 of the first body 12 is a second body 15 of single crystalline indium gallium phosphide. The second body 15 is of *p* type conductivity, preferably of a carrier concentration of between approximately $1 \times 10^{17}$ cm$^{-3}$ and $5 \times 10^{17}$ cm$^{-3}$, and is preferably of a thickness of between 0.1 and 0.5 microns. The indium gallium phosphide of the second body 15 has an indium to gallium ratio of substantially 50/50, i.e., the second body 15 is of $In_xGa_{1-x}P$ where $x$ is greater than 0.485 but less than 0.515.

On the second body 15 is a third body 16 of single crystalline semiconductor material, such as gallium arsenide. The third body 16 may be of either *p* or *n* type conductivity. Although the thickness of the third body 16 is not critical, it is typically about 250 to 400 microns. The third body 16 has an opening 18 therethrough to expose a portion of the second body 15.

On the surface 14 of the first body 12 is a thin layer 20 of an electropositive work function reducing material. The electropositive layer 20 is of an alkali or alkaline earth metal and oxygen, and is monomolecular or has a thickness not exceeding a few atomic diameters of the electropositive material. The alkali or alkaline earth metal of the electropositive layer 20 may, for example, be cesium, potassium, barium or rubidium, with cesium being the preferred metal.

Figure 2:
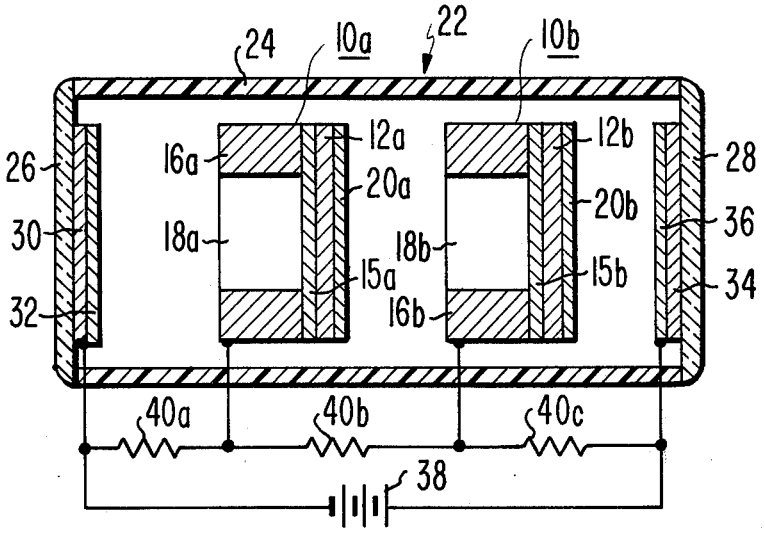
FIG. 2 is a sectional view of an electron photomultiplier device employing the electron emitting device of the present invention.

Referring to FIG. 2, there is shown an electron multiplier device 22 which includes the electron emitting device 10 of the present invention. The electron multiplier device 22 includes a cylindrical housing 24 of an opaque electrical insulating material, such as a ceramic, and end plates 26 and 28 extending across and secured to the ends of the housing 24. The end plates 26 and 28 are of a transparent material, such as glass. As will be explained, the end plate 26 is the input end of the electron multiplier device 22, and the end plate 28 is the output end.

On the inner surface of the input plate 26 is a thin, transparent layer 30 of an electrically conductive material, such as tin oxide. On the conductive layer 30 is a photoemissive layer 32 of a material which emits electrons when subjected to irradiation by visible light, such as cesium antimony. On the inner surface of the output end plate 28 is a phosphor screen 34 of an electron sensitive light emitting material, such as zinc sulfide. On the phosphor screen 34 is a thin layer 36 of an electron permeable conductive material, such as aluminum. A pair of electron emitting devices 10*a* and 10*b* of the present invention are mounted in spaced relation within the housing 24 between the end plates 26 and 28. The electron emitting device 10*a* is mounted with the opening 18*a* in the third body 16*a* facing the input end plate 26 and the electropositive work function reducing layer 20*a* facing the other electron emitting device 10*b*. The electron emitting device 10*b* is mounted with the opening 18*b* in the third body 16*b* facing the work function reducing layer 20*a* of the electron emitting device 10*a* and the work function reducing layer 20*b* facing the output end plate 28. The interior of the housing 24 is evacuated.

In the operation of the electron multiplier device 22, a potential difference is provided between the photoemissive layer 32 and the phosphor screen 34 by a battery 38 connected between the transparent conductive layer 30 and the conductive layer 36. A potential difference is also provided between the photoemissive layer 32 and the electron emitting device 10*a*, between the electron emitting device 10*a* and 10*b*, and between the electron emitting device 10*b* and the phosphor screen 34 by electrically connecting the third bodies 16*a* and 16*b* of the electron emitting devices 10*a* and 10*b* between a series of resistors 40*a*, 40*b* and 40*c* which are connected across the battery 38. Thus, the electron emitting device 10*a* is at a more positive potential than the photoemissive layer 32, the electron emitting device 10*b* is at a more positive potential than the electron emitting device 10*a*, and the phosphor screen 34 is at a more positive potential than the electron emitting device 10*b*.

Radiation which passes through the input end plate 26 and the transparent conductive layer 30 impinges on the photoemissive layer 32 causing the emission of electrons from the photoemissive layer 32. Because of the potential difference between the photoemissive layer 32 and the electron emitting device 10*a*, the electrons emitted by the photoemissive layer 32 travel toward the electron emitting device 10*a*. Such electrons pass through the opening 18*a* in third body 16*a*, through the indium gallium phosphide second body 15*a* and penetrate into the gallium arsenide first body 12*a*. The electrons entering the first body 12*a* create numerous secondary electrons which diffuse toward the electropositive work function reducing layer 20*a* and are emitted into the vacuum within the housing 24. Thus, the electron emitting device 10*a* emits a greater number of electrons than entered the electron emitting device.

The electrons emitted by the electron emitting device 10*a* flow toward the electron emitting device 10*b* because of the potential difference between the two electron emitting devices. At the electron emitting device 10*b* the electrons flow through the opening 18*b* in the third body 16*b*, through the second body 15*b* and into the first body 12*b*. The electrons entering the first body 12*b* generate numerous secondary electrons which diffuse to the electropositive work function reducing layer 20*b* and are emitted into the vacuum within the housing 24. Thus, the electron emitting device 10*b* also emits a greater number of electrons that it receives. The electrons emitted from the electron emitting device 10*b* flow to the phosphor screen 34 because of the potential difference between the electron emitting device 10*b* and the phosphor screen. The electrons pass through the conductive layer 36 and penetrate the phosphor screen 34 where the electrons are converted to visible light. The light passes from the electron multiplier device 22 through the output end plate 28. Since each of the electron emitting devices 10*a* and 10*b* emits a larger number of electrons than it receives, the number of electrons which reach the phosphor screen 34 is greater than that given off by the photoemissive layer 32. Thus, the radiation emitted from the electron multiplier device 22 is of a greater magnitude than that received by the device.

The electron multiplier device 22 can be used as a light image amplifier or as a simple photomultiplier. As an image amplifier the device 22 would include focusing means as is well known in the art. The device 22 can also be used as a radiation converter wherein one type of radiation, such as infrared, ultra-violet or x-ray, enters the device and the output radiation is of a different type, such as visible.

In the electron emitting device 10, the indium gallium phosphide second body 15 is semitransparent to electrons, i.e., it is transparent at operating potentials, so that the electrons can freely pass therethrough into the first body 12. Also, the indium gallium phosphide second body 15 covers the surface of the first body 12 through which the electrons enter the first body. This reduces the surface energy states at the surface of the gallium arsenide first body so that there are very few recombination centers. This has been determined by the fact that the reflection and transmission mode gains of the electron emitting device 10 are nearly equal. In fact, secondary emission data from the electron emitting device 10 of the present invention indicates that the indium gallium phosphide/gallium arsenide interface has a normalized surface recombination velocity ($S_b$) which is substantially smaller than 1 so that the interface is actually superior to a gallium arsenide/gallium arsenide interface in terms of having lower normalized surface recombination velocity. The indium gallium phosphide of the second body 15 has a higher bandgap than the gallium arsenide of the first body 12 so that the indium gallium phosphide/gallium arsenide interface will reflect any electrons which reach that interface back into the gallium arsenide first body 12. This helps increase the output of the electron emitting device. Electron emitting devices 10 of the present invention have been found to have transmission mode gain of 200 at 10kV and 540 at 20 kV, which are significant improvements over other types of electron emitting devices. As will be explained, using indium gallium phosphide for the second body 14 also has advantages in making the electron emitting device 10.

Figure 3:
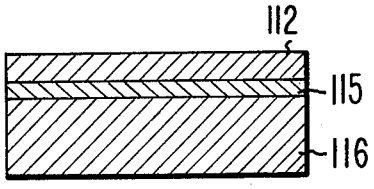
FIGS. 3 and 4 are sectional views illustrating the steps of making the electron emitting device shown in FIG. 1.

Referring to FIG. 3, the electron emitting device 10 is made by starting with a substrate 116 of gallium arsenide, which substrate has a pair of opposed, flat surfaces. A layer 115 of single crystalline *p* type conductivity, indium gallium phosphide is epitaxially deposited on one of the surfaces of the substrate 116. The layer 115 is of a thickness corresponding to the desired thickness of the second body 15 of the electron emitting device 10. The layer 115 is epitaxially deposited by the technique of vapor phase epitaxy, such as described in the article of A. G. Sigai et al, entitled "Vapor Growth of $In_{1-x}Ga_xP$ for P-N Junction Electroluminescence", published in JOURNAL OF ELECTROCHEMICAL SOCIETY, Vol. 120, No. 7, July 1973, pages 947–955. As described in this article the deposition is from a gas containing the elements of the material being deposited. For indium gallium phosphide the gas is a mixture of the chloride of indium and gallium and phosphine. Vapors of a *p*-type dopant, such as zinc or cadmium, are included to provide a *p*-type conductivity material. A layer 112 of single crystalline gallium arsenide of *p* type conductivity is then epitaxially deposited on the indium gallium phosphide layer 114. The gallium arsenide layer 112 is of a thickness equal to the desired thickness of the first body 12 of the electron emitting device 10. The gallium arsenide layer 112 is also deposited by the technique of vapor phase epitaxy. To deposit gallium arsenide the gas from which the deposition occurs may be a mixture of arsine and a chloride of gallium. Vapors of a *p*-type dopant, such as zinc, may also be included to deposit a *p*-type conductivity material.

Figure 4:
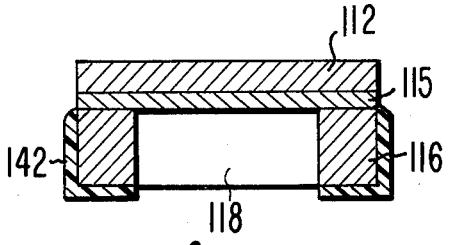

As shown in FIG. 4, a layer 142 of a resist material, such as wax, is coated on the surfaces of the substrate 116 except for the central portion of the flat surface opposite the surface on which is the layer 114. If desired the resist layer 142 can be also coated over any exposed portion of the layers 115 and 112. The exposed surface portion of the substrate 116 is then subjected to an etchant which will etch the gallium arsenide but will not as readily etch indium gallium phosphide, such as Caro's etch. The substrate 116 is subjected to the etchant until an opening 118 is etched through the substrate 116 exposing the epitaxial layer 115. Since the indium gallium phosphide is not subjected to be etched by the etchant, the etching process will stop when the epitaxial layer 115 is reached. The resist layer 142 is then removed, and the layer 20 of the electropositive work function reducing material is coated on the gallium arsenide layer 112. The electropositive work function reducing layer 20 can be applied by the well known technique of evaporation in a vacuum. In making the electron emitting device 10, the use of indium gallium phosphide as the second body has a major advantage in that indium gallium phosphide having an indium to gallium ratio of 50/50 has a crystalline lattice parameter which substantially matches that of gallium arsenide. Thus, when the gallium arsenide layer is deposited on the indium gallium phosphide layer, the interface will have four recombination centers and the gallium arsenide layer will be substantially free of dislocations and strain. Thus, the electron emitting device 10 can be provided with an active region of good crystalline quality so that the device has good electrical characteristics. Also, the use of indium gallium phosphide provides for greater ease of forming the opening in the substrate since the etching of the opening will substantially automatically stop when the indium gallium phosphide layer is reached since indium gallium phosphide is substantially more resistive than gallium arsenide to most etchants.

We claim:

1. An electron emitting device comprising
- a first body of single crystalline gallium arsenide having opposed, substantially flat surfaces,
- a second body of single crystalline indium gallium phosphide on one of the surfaces of said first body, said second body being thinner than said first body, and
- a layer of an electropositive work function reducing material on the other of said surfaces of said first body.

2. An electron emitting device in accordance with claim 1 wherein the ratio of indium to gallium in the second body is such that the lattice parameter of said second body substantially matches the lattice parameter of the first body.

3. An electron emitting device in accordance with claim 2 in which the ratio of indium to gallium in the second body is substantially 50/50.

4. An electron emitting device in accordance with claim 3 including a third body of single crystalline semiconductor body on said second body, said third body having an opening therethrough exposing a portion of the second body.

5. An electron emitting device in accordance with claim 1 in which the second body is of a thickness of between 0.1 and 0.5 microns.

6. An electron emitting device in accordance with claim 5 in which the first body is of a thickness of between 1 and 4 microns.

7. A method of making an electron emitting device comprising the steps of
- epitaxially depositing on a substantially flat substrate of single crystalline gallium arsenide a layer of single crystalline indium gallium phosphide,
- epitaxially depositing on said indium gallium phosphide layer a layer of single crystalline gallium arsenide which is thicker than the indium gallium phosphide layer,
- and then removing at least a portion of said substrate to expose at least a portion of said indium gallium phosphide layer.

8. The method in accordance with claim 7 in which the substrate is removed with an etchant which etches gallium arsenide but not indium gallium phosphide.

9. The method in accordance with claim 8 in which the etchant is Caro's etch.

10. The method in accordance with claim 8 in which the layers are epitaxially deposited by vapor deposition from a gas containing the elements of the layer.

11. The method in accordance with claim 7 including depositing a layer of a work function reducing material on the gallium arsenide layer.

* * * * *